US007104035B2

(12) United States Patent
Hähnel

(10) Patent No.: US 7,104,035 B2
(45) Date of Patent: Sep. 12, 2006

(54) BLISTER PACKAGING MACHINE

(75) Inventor: Bernd Hähnel, Stutense (DE)

(73) Assignee: IWK Verpackungstechnik GmbH, Stutensee (DE)

( * ) Notice: Subject to any disclaimer, the term of this patent is extended or adjusted under 35 U.S.C. 154(b) by 0 days.

(21) Appl. No.: 10/505,672

(22) PCT Filed: Jan. 20, 2004

(86) PCT No.: PCT/EP2004/000380

§ 371 (c)(1),
(2), (4) Date: Aug. 25, 2004

(87) PCT Pub. No.: WO2004/065221

PCT Pub. Date: Aug. 5, 2004

(65) Prior Publication Data

US 2005/0102980 A1 May 19, 2005

(30) Foreign Application Priority Data

Jan. 23, 2003 (DE) ..... 103 02 725

(51) Int. Cl.
*B65B 47/00* (2006.01)

(52) U.S. Cl. ..... 53/561; 53/246; 53/250; 53/534; 221/203; 221/265

(58) Field of Classification Search ..... 53/558–561, 53/250, 253, 246, 247, 285, 235, 534; 221/201–203, 221/265

See application file for complete search history.

(56) References Cited

U.S. PATENT DOCUMENTS

| | | | | |
|---|---|---|---|---|
| 2,732,987 | A | 1/1956 | Moore | |
| 3,389,531 | A * | 6/1968 | Ehe et al. | 53/155 |
| 3,464,182 | A * | 9/1969 | Nichols | 53/559 |
| 3,724,165 | A | 4/1973 | Nichols | |
| 4,115,040 | A * | 9/1978 | Knorr | 417/420 |
| 4,676,378 | A * | 6/1987 | Baxley et al. | 206/554 |
| 5,603,203 | A * | 2/1997 | Robache | 53/559 |
| 6,054,788 | A * | 4/2000 | Dombrovski et al. | 310/103 |
| 6,510,676 | B1 * | 1/2003 | Gauthier | 53/501 |
| 6,648,575 | B1 * | 11/2003 | Baroncini | 414/300 |
| 2004/0237468 | A1 * | 12/2004 | Baroncini | 53/251 |
| 2004/0244339 | A1 * | 12/2004 | Dal Pozzo | 53/453 |

FOREIGN PATENT DOCUMENTS

| | | |
|---|---|---|
| DE | 26 14 928 | 10/1977 |
| DE | 38 42 273 | 6/1989 |
| DE | 43 10 417 | 10/1994 |
| EP | 0 388 361 | 9/1990 |
| EP | 1 129 009 | 9/2001 |
| FR | 2 759 346 | 8/1998 |
| WO | WO 01/28860 A1 * | 4/2001 |

* cited by examiner

*Primary Examiner*—Louis K. Huynh
*Assistant Examiner*—Thanh Truong
(74) *Attorney, Agent, or Firm*—Paul Vincent

(57) ABSTRACT

A blister packaging machine comprises a forming station in which a plurality of cup-shaped depressions can be formed into a bottom sheet, a filing station, in which a product can be filled into the cup-shaped depressions, and a downstream sealing station, in which a cover sheet can be sealed onto the bottom sheet. The filling station comprises a brush box disposed above the bottom sheet, in which several rotatably driven roller brushes are disposed parallel to each other. The roller brushes are connected to a rotary drive which is received in a drive gearbox disposed next to the brush box. A magnetic coupling is thereby provided for transmitting a drive motion of the rotary drive to the roller brushes through a wall of the drive gearbox.

6 Claims, 5 Drawing Sheets

BLISTER PACKAGING MACHINE

This application is the national stage of PCT/EP2004/000380 filed on Jan. 20, 2004 and also claims Paris Convention priority of DE 103 02 725.4 filed Jan. 23, 2003.

BACKGROUND OF THE INVENTION

The invention concerns a blister packaging machine comprising a forming station, in which a plurality of cup-shaped depressions can be formed into a bottom sheet, a filling station, in which a product can be filled into the cup-shaped depressions, and a downstream sealing station in which a cover sheet can be sealed onto the bottom sheet, wherein the filling station comprises a brush box which is disposed above the bottom sheet and which contains several rotary driven roller brushes disposed parallel and next to each other, the roller brushes being connected to a rotary drive which is accommodated in a drive gearbox disposed next to the brush box.

A blister packaging machine of conventional structure comprises a forming station, in which a plurality of cup-shaped depressions are formed into a bottom sheet which consists of plastic material or aluminum. A product, e.g. a pharmaceutical tablet, is inserted into each depression at a downstream filling station. After product supply, the bottom sheet is transported to a sealing station. A cover sheet is introduced directly before or within the sealing station and is disposed on the bottom sheet. The cover sheet is tightly sealed onto the bottom sheet within the sealing station using heat, thereby enclosing the product in the cup-shaped depression.

The forming station is usually operated in cycles and therefore discontinuously. The filling and sealing stations can also be operated in cycles or, alternatively, continuously, wherein conventional compensation means effect transfer between cyclical operation of the forming station and continuous operation of the filling and sealing stations.

The filling station comprises a brush box which contains a plurality of roller brushes which are disposed in a rotating fashion and are in mutual, close and parallel adjacency to each other, and extend transverse to the direction of motion of the bottom sheet. The brush box is disposed directly above the bottom sheet and the cup-shaped depressions are open in an upward direction, i.e. facing the brush box. A sufficient amount of product, e.g. a large number of tablets, is supplied to the upper side of the brush box. The brush box has the task of distributing the tablets over the bottom sheet passing below it, such that the tablets fall into the cup-shaped depressions of the bottom sheet. A drive gearbox is disposed next to the brush box, which accommodates a drive for rotating the roller brushes. Each roller brush usually has its own drive motor whose rotary or drive motion is transmitted to the associated roller brush by a shaft which penetrates through an opening in the wall of the drive gearbox.

The number and design of the roller brushes in the brush box depends on the type and size of the product to be filled in. Format change during operation of the blister packaging machine therefore requires dismounting the brush box and replacing it with another brush box of suitable structure. Towards this end, each roller brush shaft must be released from its respective drive motor. After installation of the new brush box, the new roller brush shafts must be re-connected to the drive motors. Alternatively, the drive motors are conventionally dismounted together with the roller brushes for product change when the brush box is replaced by another supply system. Such handling is time-consuming and expensive.

Since product dust or product chips are always produced in the region of the brush box, the above-mentioned brush box structure always bears the risk of having these particles penetrate into the coupling and the opening region of the drive shafts, thereby soiling it. During product change, these locations must be thoroughly cleaned to prevent residues of previously processed product from entering into the new product to be subsequently processed.

It is the underlying purpose of the invention to produce a blister packaging machine of the above-mentioned type, wherein the brush box can be replaced in a simple manner while reliably preventing brush box particles from entering into the drive gearbox.

SUMMARY OF THE INVENTION

This object is achieved in accordance with the invention with a blister packaging machine of the above-mentioned type by providing a magnetic coupling which transmits a drive motion of the rotary drive to the roller brushes that passes through a closed drive gearbox wall.

In accordance with the invention, the drive motion of the rotary drive is thereby transferred to the roller brushes in a contact-free manner with the consequence that the wall of the drive gearbox does not need any openings for passage of a drive shaft and the drive gearbox is completely and homogeneously isolated from the brush box to prevent particles from getting from the drive gearbox into the brush box or from the brush box into the drive gearbox.

Since the magnetic coupling transfers the drive motion from the drive gearbox to the brush box in a contact-free manner, the brush box can be replaced without having to release special mechanical connections between the rotary drive and the roller brushes. In this manner, the brush box can be replaced with another brush box in a rapid and simple manner.

The rotary drive preferably comprises a plurality of drive motors with each roller brush having its own drive motor. Each drive motor is connected to the associated roller brush via a magnetic coupling of the above-mentioned structure.

The magnetic coupling preferably comprises a first magnet which is disposed on the drive motor or its output shaft and within the drive gearbox, close to a wall thereof, and a second magnet which is connected to the shaft of the associated roller brush. The second magnet is disposed on the outer side of the drive gearbox close to its wall and opposite the first magnet. To minimize the separation between the two magnets and to ensure good transmission of the torque in this fashion, the wall of the drive gearbox should be as thin as possible. Since this is frequently not possible for reasons of stability, in a thicker wall design of the drive gearbox, the first magnet may be disposed in a recess of the drive gearbox wall. The bottom of the recess forms the separating wall of the drive gearbox in this region and defines the separation from the second magnet, disposed on the opposite side of that bottom wall.

The second magnet may be rigidly mounted to the shaft of the associated brush roller and is then replaced together with the brush box when the format is changed. Since magnets are relatively expensive, in a preferred embodiment of the invention, the second magnet is releasably connected to the shaft of the roller brush. When the brush box is changed, the connection between the shafts of the roller brushes and the second magnet is also released such that the second magnets can be used for different brush boxes.

In a preferred embodiment of the invention, the second magnets are rotatably disposed and held outside of the brush box, e.g. by providing a bearing wall between the drive gearbox and the brush box, in which the second magnet is rotatably disposed. The bearing wall is disposed on the rear side of the second magnet, facing away from the first magnet, and has an opening into which a projection of the second magnet, or a bearing sleeve mounted thereto, is rotatably inserted. The shaft of the associated roller brush may come into and out of engagement with a coupling formed on the bearing sleeve at a side of the bearing wall facing away from the second magnet. When the brush box is removed, the shafts of the roller brushes are disengaged from the bearing sleeve of the second magnets without the use of tools. In correspondence therewith, the shafts of the new roller brushes are inserted into the bearing sleeves of the second magnets when a new brush box is inserted, such that the roller brushes are coupled to the associated drives via the magnetic coupling.

The bearing wall may be removed along with the second magnets held therein, to provide simple cleaning of the smooth outer side of the drive gearbox during format change.

In a further development of the invention, the shafts of the roller brushes are each formed as rods which can be removed, whereby individual roller brushes of a brush box can be replaced in a simple advantageous manner by pulling out the shaft disposed in opposite side walls of the brush box, removing the roller brush and subsequently mounting a new roller brush onto the shaft.

The drive motors can be controlled independently of each other and their rotational speed can be varied. If a new product is supplied to the upper side of the brush box, it takes some time for the product, e.g. tablets, to be distributed over the entire brush box through rotation of the roller brushes. To accelerate distribution of the tablets in the brush box after format change, the direction of rotation of the drive motors may also be reversed, thereby permitting precise transport of tablets within the brush box through corresponding control of the drive motors.

The brush box may have an associated sensor mechanism which detects the product filling level of the brush box. The sensor mechanism may have a capacitive or mechanical structure. Light barriers could, however, also be used. The supply device drive, e.g. a vibrating hopper, through which the products are supplied to the brush box, can be controlled in dependence on the determined product fill level of the brush box.

Simple dismounting and mounting of the brush box with exact positioning relative to the drive gearbox and the second magnets can be obtained when the brush box is disposed on the drive gearbox using pivotable brackets. When the brackets have been pivoted from an operating position of the brush box into an exchange position, the brush box can be simply removed from the brackets and be replaced by another brush box.

To prevent excessive formation of dust within the brush box, the brush box may have an associated suction device to vacuum dust.

Further details and features of the invention can be extracted from the following description of an embodiment with reference to the drawing.

DESCRIPTION OF THE PREFERRED EMBODIMENT

Figure 1:
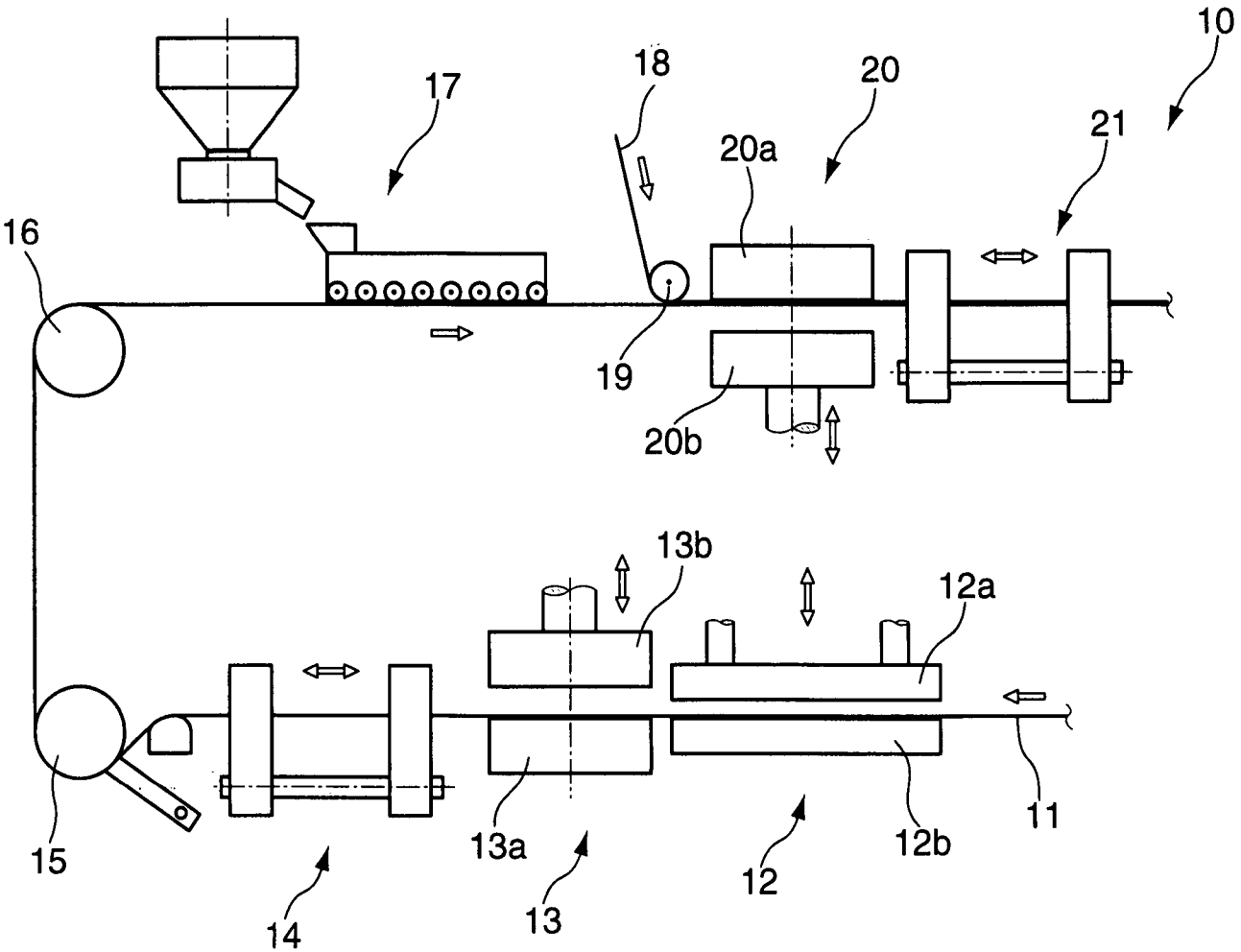
FIG. 1 shows a schematic view of the essential stations of a blister packaging machine.

FIG. 1 shows a schematic view of the essential components of a blister packaging machine 10. A bottom sheet 11 of plastic material is delivered from a supply and is initially guided to a heating station 12 which comprises a lower heating plate 12*b* and an upper heating plate 12*a* which can be adjusted relative to the lower heating plate 12*b*. When the two heating plates 12*a* and 12*b* are closed, the bottom sheet 11 received between them is heated.

A forming station 13 directly borders the heating station 12 and comprises a lower forming plate 13*a* and an upper forming plate 13*b* which can be adjusted relative thereto. The two forming plates 13*a* and 13*b*, which are shown in an open position, can be closed, wherein the bottom sheet which is received between the closed forming plates 13*a* and 13*b* is cooled and simultaneously provided with cup-shaped depressions through supply of pressurized air or through forming dies. The forming station 13 is joined by a transport device 14 for drawing the bottom sheet 11, in cycles, through the forming station 13 and the heating station 12.

The bottom sheet 11 having the cup-shaped depressions is then passed to a filling station via deflecting rollers 15 and 16, in which a product, e.g. a pharmaceutical tablet is introduced into each depression. The bottom sheet 11 is then transferred to a sealing station 20. A cover sheet 18 is disposed onto the bottom sheet 11 via a deflecting roller 19 directly before the sealing station 20. The cover sheet 18 is sealed onto the bottom sheet 11 in the sealing station 20, which comprises a lower sealing plate 20*b* and an upper sealing plate 20*a*, by closing the sealing plates 20*a* and 20*b* and applying heat onto the sheets. The sealing station 20 is followed by a further transport device 21 whose motion is synchronized with the transport device 14 and provides cycled transport of the sheet composite produced after the sealing station 20.

FIGS. 2, 3, 4 and 5 show the filling station 17 in detail. The station 17 comprises a drive gearbox 22 which is fixed in the machine and which accommodates a rotary drive 31 which comprises a plurality of independent drive motors 31*a*, in particular, direct current motors. The drive gearbox 22 may be covered by a lid (not shown).

Each drive motor 31*a* has an output shaft 31*b* on which a first magnet 32 in the form of a permanent magnet is disposed. The first magnet 32 is partially inserted into a recess 33 formed in a wall 22*a* of the drive gearbox 22. The bottom 33*a* of the recess 33 forms a thin-walled section of the wall 22*a* of the drive gearbox 22.

One pivot bearing 35 is disposed at each opposite front end of the drive gearbox 22 close to the wall 22*a*, and pivotably bears a bracket 34 which extends along the side of the drive gearbox 22. A brush box 23 can be releasably inserted into the brackets 34. A bearing wall 30, which extends parallel to the wall 22*a*, is disposed at a separation from the wall 22*a* between the wall 22*a* of the drive gearbox 22 and the brush box 23. A top cover 30*a*, which extends towards the wall 22*a* of the drive gearbox 22, is disposed at the upper end of the bearing wall 30 and covers the space between the wall 22*a* and the bearing wall 30. The space between the bearing wall 30 and the wall 22*a* of the drive gearbox 22 accommodates a second magnet 28 which faces the first magnet 32 on the inner side of the drive gearbox 22 and which is separated therefrom by the bottom 33*a* of the recess 33. The second magnet 28 has a pin-shaped projection in the form of a stub axis 28*a* on its side facing away from the first magnet 32, with which it seats in a bearing bushing 29 which is disposed in an opening of the bearing wall 30. The second magnet 28 is rotatably disposed in the bearing bushing 29 via the stub axis 28*a*, but axially held in the bearing wall 30 by a securing plate 39. The stub axis 28*a* has connecting parts 28*b* disposed on its side facing away from the second magnet 28 and facing the brush box 23, which couple to a shaft 26 of a roller brush 25.

The two magnets 32 and 28 form a magnetic coupling 27 through which the rotary motion of the drive motor 31*a* can be transferred through the closed wall 22*a* of the drive gearbox 22 in a contact-free manner.

The brush box 23 comprises four side walls, one of which 23*a* extends at a small separation from and parallel to the bearing wall 30. The shaft 26 is inserted into an opening formed in the side wall 23*a* and an opening formed in the opposite side wall 23*b*. The shaft 26 penetrates through an axial bore 25*a* of the roller brush 25 which is connected to the shaft 26 for secure mutual rotation therewith. A holder 37 is disposed on the outer side of the side wall 23*b* of the brush box 23 facing away from the magnetic coupling 27 to rotatably hold the shaft 26 and which can be removed to pull the shaft 26 out of the brush box 23.

Figure 4:
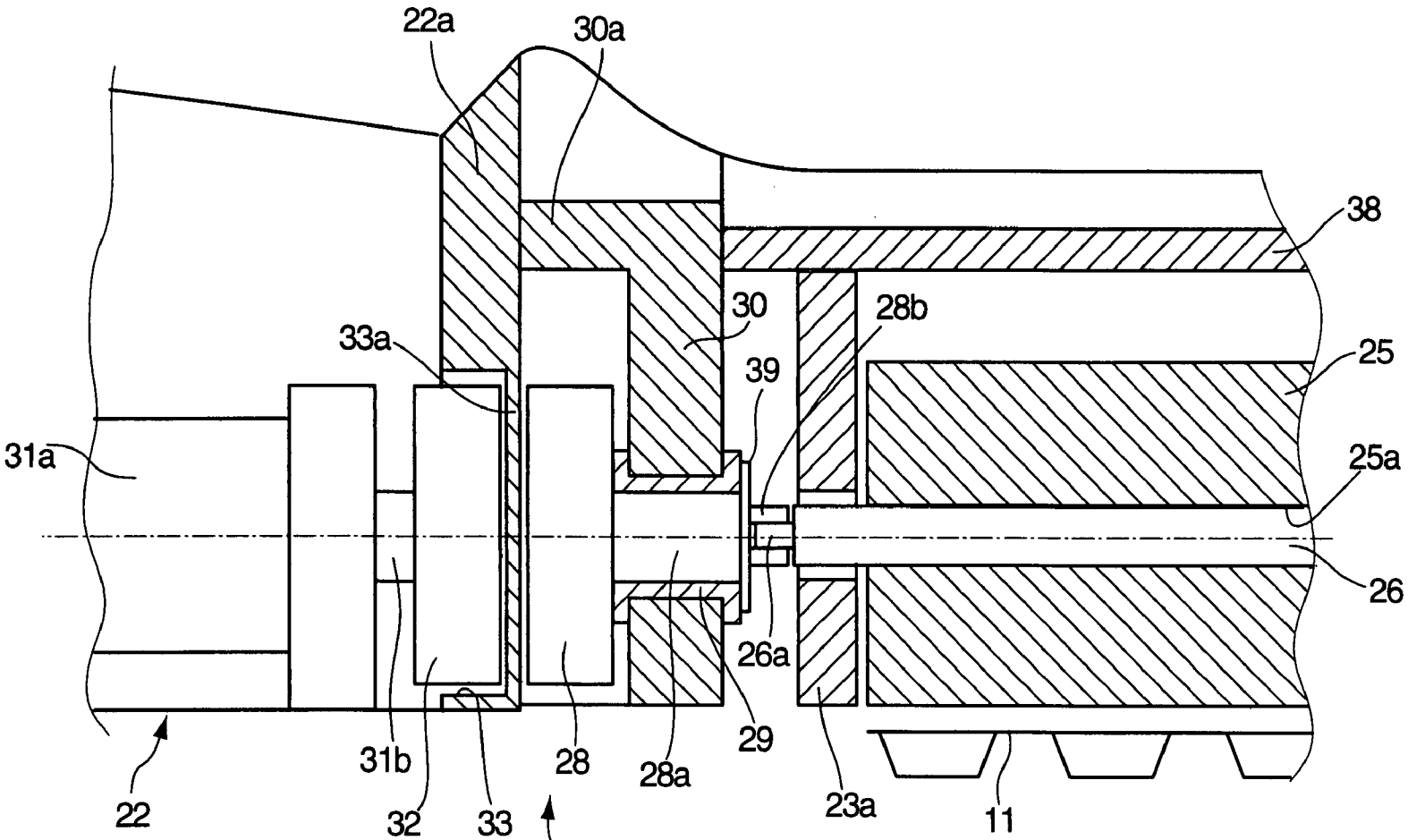
FIG. 4 shows an enlarged view of the magnetic coupling of FIG. 3.
Figure 5:
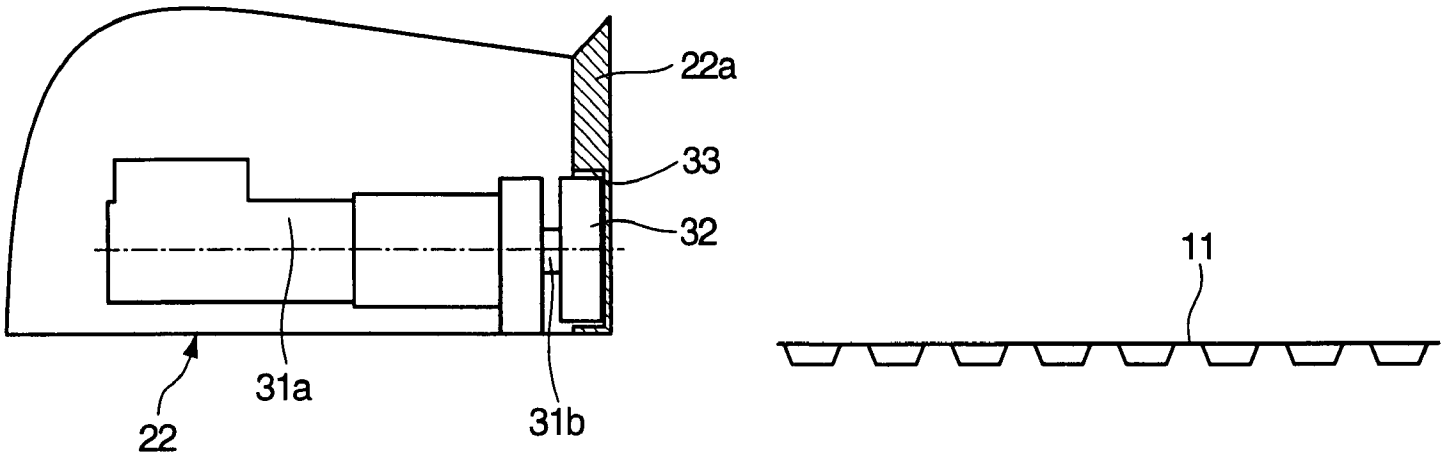
FIG. 5 shows a view corresponding to FIG. 3 with the brush box removed.

As shown in particular in FIG. 4, the shaft 26 has an axially protruding chamfered pin 26*a* on its end facing the magnetic coupling 27 on the outer side of the brush box 23, which can be brought into engagement with the connecting parts 28*b* of the stub axis 28*a*. A rotary drive motion of the drive motor 31*a* can thereby be transmitted via its output shaft 31*b* to the first magnet 32 which rotates within the drive gearbox 22. The rotation of the first magnet 32 produces a corresponding rotation of the second magnet 28 disposed outside of the drive gearbox 22, which rotates together with the stub axis 28*a*. Rotation of the stub axis 28*a* is transmitted via its connecting parts 28*b* and via the pin 26*a* to the shaft 26 which rotates within the brush box 23 thereby carrying along the roller brush 25.

The brush box 23 is covered by a top side lid 38. The lid is omitted in FIG. 2 to show a plurality of packed, parallel adjacent roller brushes 25 disposed within the brush box 23 which all have the above-mentioned structure and each of which is driven by its own drive motor 31*a*. The shafts 26 of the roller brushes 25 extend perpendicularly to the direction of motion of the bottom sheet 11 which travels directly below the brush box 23 (FIG. 3).

A product is supplied to the upper side of the brush box 23 via a funnel 24, the product being, in particular, dragees or tablets. When exchanging the brush box in order to change the format, the brush box 23 is pivoted together with the brackets 34 about the pivot bearings 35 into a lifted position, wherein the connecting parts 28*b* disengage from the pins 26*a* of the shafts 26. The brush box 23 can be removed from the brackets 34 in this pivoted position. The bearing wall 30 can subsequently be removed from the drive gearbox 22 with the second magnets 28 held therein, to create a smooth outer side of the drive gearbox 22 (see FIG. 5). This design facilitates cleaning of the drive gearbox for product or format change. The same or another bearing wall 30 with corresponding second magnets 28 held therein is then disposed on the drive gearbox, followed by insertion of a new brush box of desired structure into the brackets 34. The brackets are then pivoted back into the initial position (FIG. 2) together with the new brush box, wherein the pins 26*a* of the shafts 26 of the new brush box engage in the connecting parts 28*b* of the stub axis 28*a* thereby connecting the shafts 26 to the associated second magnet 28 and to the associated drive motor 31*a* via the magnetic coupling 27.

Figure 2:
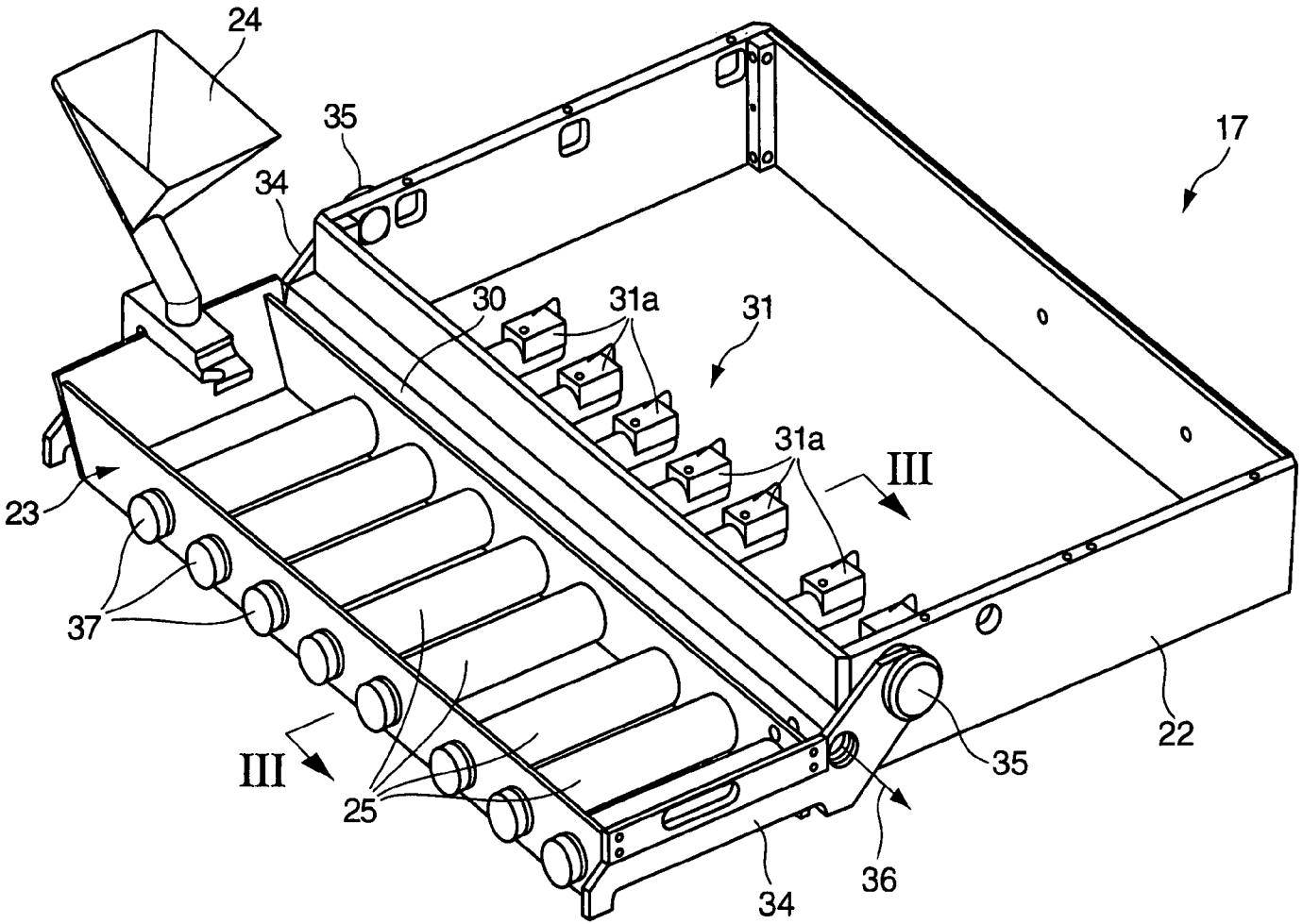
FIG. 2 shows a perspective view of the filing station, with removed lids.
Figure 3:
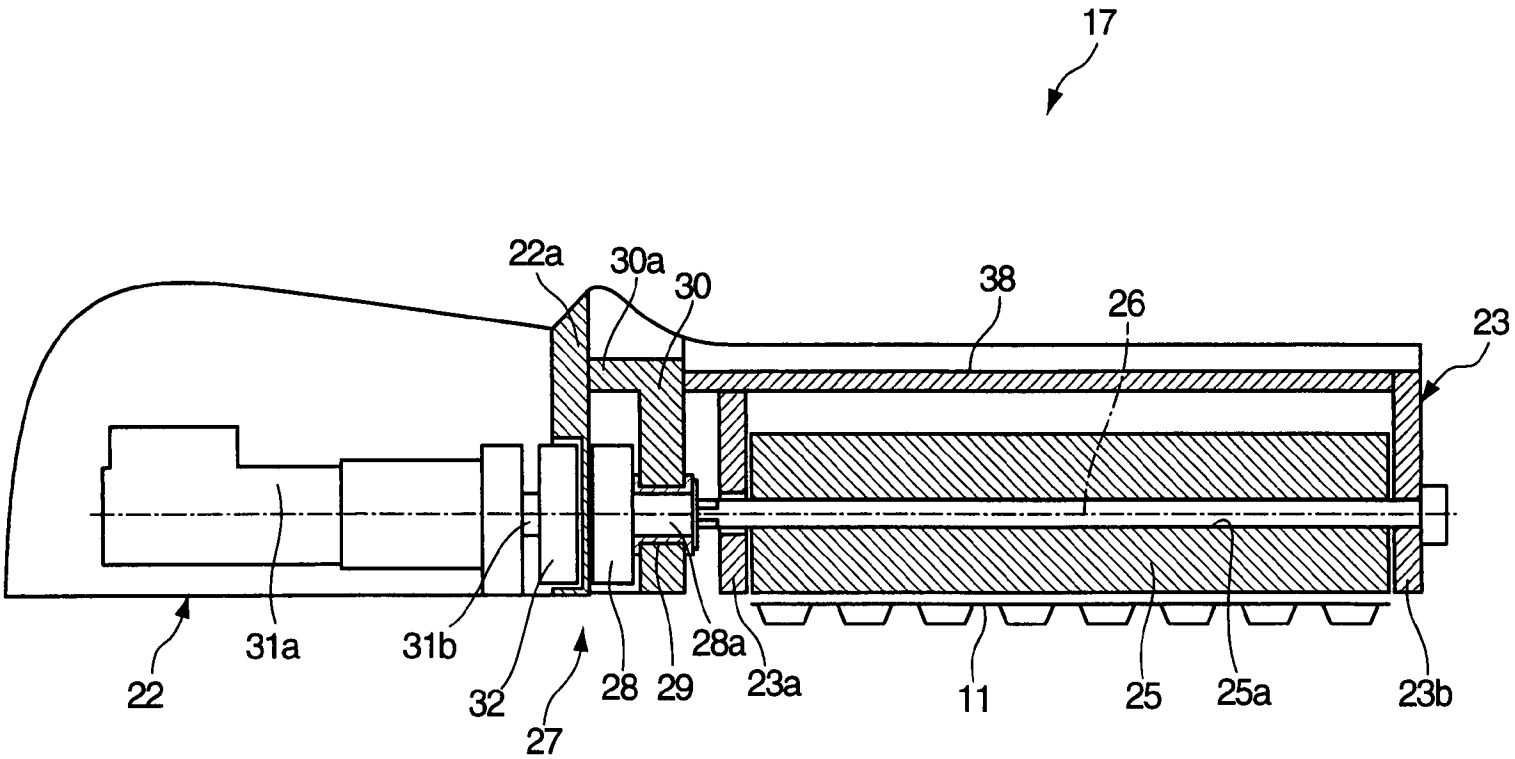
FIG. 3 shows the section III—III of FIG. 2.

As shown in FIG. 2, the brush box 23 has an associated suction device 36 (only indicated by an arrow) for suctioning residues from the inside of the brush box 23.

I claim:

1. A blister packaging machine having a forming station in which a plurality of cup-shaped depressions are formed in a bottom sheet, a filling station in which a product is filled into the cup-shaped depressions, and a downstream sealing station in which a cover sheet is sealed onto the bottom sheet, the filling station comprising:

a brush box disposed above the bottom sheet, said brush box having several rotationally driven roller brushes disposed parallel to each other;

a drive gearbox disposed next to said brush box, said drive gearbox having a rotary drive mechanism, said drive gearbox also having a closed wall disposed between said rotary drive mechanism and said brush box;

a first magnetic coupling means disposed within said drive gearbox and coupled to said rotary drive mechanism, said first magnetic coupling means having a first magnet disposed proximate an inner side of said closed wall;

a bearing wall disposed between said drive gearbox and said brush box, said bearing wall mounted to said closed wall to define a gap between an outer side of said closed wall and an inner side of said bearing wall; and a second magnetic coupling means, said second magnetic coupling means having a second magnet disposed within said gap in coupling magnetic communication with said first magnet, said second magnetic coupling means also having a shaft cooperating with said second magnet and borne for rotation by said bearing wall, wherein an end of said shaft penetrates through said bearing wall outside of said gap, said shaft end having means for connection to and disconnection from said roller brush.

2. The blister packaging machine of claim 1, wherein said rotary drive comprises a plurality of drive motors, wherein each roller brush has own drive motor.

3. The blister packaging machine of claim 2, wherein said drive motors can be controlled independently of each other, and each drive motor has a rotational direction which can be reversed.

4. The blister packaging machine of claim 1, wherein said first magnet is disposed in a recess in said closed wall of said drive gearbox.

5. The blister packaging machine of claim 1, further comprising brackets with which said brush box is pivotably disposed on said drive gearbox.

6. The blister packaging machine of claim 5, wherein said brush box is disposed on said brackets in a replaceable manner.

* * * * *